US006853873B1

(12) United States Patent
Rollo et al.

(10) Patent No.: US 6,853,873 B1
(45) Date of Patent: Feb. 8, 2005

(54) ENHANCED THROUGHPUT OF A METROLOGY TOOL

(75) Inventors: Jason H. Rollo, Alamo, CA (US); Jaime Poris, Boulder Creek, CA (US)

(73) Assignee: Nanometrics Incorporated, Milpitas, CA (US)

( * ) Notice: Subject to any disclaimer, the term of this patent is extended or adjusted under 35 U.S.C. 154(b) by 0 days.

(21) Appl. No.: 10/370,920

(22) Filed: Feb. 21, 2003

(51) Int. Cl.[7] ..... G06F 19/00

(52) U.S. Cl. ..... 700/121; 700/109; 700/110; 438/14

(58) Field of Search ..... 700/109, 110, 700/121, 45, 67, 97, 303; 438/14, 7, 16, 800; 324/207.23, 227, 229; 356/630, 640; 702/97

(56) References Cited

U.S. PATENT DOCUMENTS 3,751,647 A * 8/1973 Maeder et al. ..... 713/401
6,298,470 B1 * 10/2001 Breiner et al. ..... 716/4
6,340,602 B1 * 1/2002 Johnson et al. ..... 438/7
6,346,426 B1 * 2/2002 Toprac et al. ..... 438/8
6,485,990 B1 * 11/2002 Lansford ..... 438/5
6,505,090 B1 * 1/2003 Harakawa ..... 700/121
6,535,774 B1 * 3/2003 Bode et al. ..... 700/109
2002/0193899 A1 12/2002 Shanmugasundram et al. ..... 700/108
2003/0020928 A1 * 1/2003 Ritzdorf et al. ..... 356/630

* cited by examiner

*Primary Examiner*—Leo Picard
*Assistant Examiner*—Carlos Ortiz Rodriguez
(74) *Attorney, Agent, or Firm*—Silicon Valley Patent Group LLP

(57) ABSTRACT

The throughput of a metrology module is enhanced by measuring a first parameter of a processed substrate and only measuring additional parameters if warranted from an analysis of the first parameter. Thus, after a substrate is processed, a first parameter related to the processing is measured and analyzed. If the measured parameter falls within accepted tolerance, the data is reported and then next substrate is processed. If, however, the measured parameter falls outside the range of accepted tolerance, the second parameter or additional parameters are measured and analyzed. The data can then be reported, the processing of subsequent substrate stopped and/or the processing of subsequent substrates adjusted based on the analyzed data.

32 Claims, 1 Drawing Sheet

ENHANCED THROUGHPUT OF A METROLOGY TOOL

FIELD OF THE INVENTION

The present invention is related to metrology, and in particular to efficiently measuring parameters indicative of the quality of the processing of a substrate.

BACKGROUND

To improve the performance of a process tools, a metrology module is typically employed to measure processing parameters on the substrate after the substrate has been processed. If one or more of the process parameters are outside an acceptable tolerance range, the substrate is reprocessed or rejected. Moreover, the process tool may be adjusted to avoid faulty processing of subsequent substrates.

One of the requirements of the metrology module is that it does not degrade the throughput capability of the process tool. In general, to improve throughput, it is desirable for the measurement speed to be as fast as possible favoring less measurement locations on each sample or only measuring a fraction of the total number of samples being processed. However, to improve the probability of detecting and analyzing a problem with the process tool, a large number of measurement locations and all of the processed samples should be measured. Thus, a balance is typically struck between throughput and sampling rate.

Once the metrology measurement is made, the data can be used two different ways. In the passive mode, the metrology data is analyzed to see if it is within the acceptable tolerance range of the process tool. If it is, no further action is taken and the process tool continues processing subsequent substrates. The engineer may also choose to slightly modify the process parameters if, for instance, a small drift is observed within the acceptable tolerance range. If the data is not within the acceptable tolerance range, however, this information is provided to the engineer and/or used to stop the processing of subsequent substrates.

In the active mode, the metrology data is analyzed in the same manner. If the data indicates the process is well centered in the tolerance range, no further action is taken. However, if the data indicates that the process is skewed from the center of the tolerance range but within the tolerance range, some parameter associated with the process may be modified to attempt to center the one or more parameters being measured. If the data indicates that the response is not within the tolerance range, this information is used to alert the engineer and/or stop the processing of subsequent substrates.

Conventionally, measurements of all important parameters related to the processing of the substrate are made on a designated number of processed substrates at a designated number of locations. To increase throughput, less than all of the processed substrates or less locations on a substrate are typically measured, which unfortunately increases the risk of not detecting problems associated with the processing tool. For example, every fifth wafer could be measured for two parameters at five sites on the wafer to not degrade the throughput of the process tool. The engineer's choice of measuring frequency and number of locations per substrate can vary tremendously based on numerous parameters. Thus, what is needed is an enhancement to the throughput of the metrology module to increase the sampling rate of the number of substrates and the number of sites per substrate.

SUMMARY

In accordance with an embodiment of the present invention, the throughput of a metrology module is enhanced by measuring a first parameter of a processed substrate and only measuring additional parameters if warranted from an analysis of the first parameter. Thus, after a substrate is processed, a first parameter that is related to the processing is measured and analyzed. If the measured parameter falls within accepted tolerance, the data is reported and then the next substrate is processed. If, however, the measured parameter falls outside the range of accepted tolerance, the second parameter or additional parameters are measured and analyzed. The data can then be reported, the processing of subsequent substrate stopped and/or the processing of subsequent substrates adjusted based on the analyzed data. By way of example, the processing of the substrate may be chemical mechanical polishing and the first and second parameters measured may be metal loss and residue on the substrate, respectively.

A method, in accordance with one embodiment of the present invention, includes measuring a first parameter of a substrate after the substrate has been processed; analyzing the data from the measured first parameter; and determining whether to measure a second parameter of the substrate based on the analyzed data. The method may further include measuring a second parameter of the substrate and analyzing the data from the measured second parameter. The method may also include processing a second substrate; measuring the first parameter of the second substrate; analyzing the data from the measured first parameter of the second substrate; and determining whether to measure a second parameter of the second substrate based on the analyzed data from the measured first parameter of the second substrate.

In another embodiment, an apparatus includes a processing module that processes a substrate and a metrology module coupled to the processing module, the metrology module measures a first parameter and a second parameter of a processed substrate. The apparatus includes a computer system coupled to the processing module and the metrology module, where the computer system receives from the metrology module data for the first parameter and the second parameter. The computer system having a computer-usable medium having computer-readable program code embodied therein for instructing the metrology module to measure the first parameter of a substrate after the substrate has been processed; analyzing the data from the measured first parameter; and determining whether to measure a second parameter of the substrate based on the analyzed data. The computer-readable program code is further for instructing the metrology module to measure the second parameter of a substrate; and analyzing the data from the measured second parameter.

In yet another embodiment, an apparatus includes a processing module that processes a substrate and a metrology module coupled to the processing module. The metrology module includes a first measuring tool and a second measuring tool that measure the critical dimension of at least one location on the substrate in different ways. The apparatus includes a computer system coupled to the processing module and the metrology module, where computer system receives a first set of data of the critical dimension from the first critical dimension measuring tool and a second set of data of the critical dimension from the second critical dimension measuring tool. The computer system having a computer-usable medium having computer-readable program code embodied therein for instructing said metrology module to measure said critical dimension with said first critical dimension measuring tool after the substrate has been processed; analyzing the data from the first critical dimension measuring tool; and determining whether to measure the critical dimension with the second critical dimension measuring tool based on the analyzed data. The computer-readable program code is further for instructing the metrology module to measure the critical dimension with the second critical dimension measuring tool and analyzing the data from the second critical dimension measuring tool. The first critical dimension measuring tool may be an optical critical dimension tool and the second critical dimension measuring tool may be a critical dimension scanning electron microscope (CD-SEM).

DETAILED DESCRIPTION

A metrology module, in accordance with an embodiment of the present invention, may be used to efficiently monitor the performance of a process tool by using the analysis of one parameter to determine whether additional parameters should be measured and optionally where they should be measured. By only measuring an additional parameter when one or more previously measured parameters indicate that there may be a change or problem in the additional parameter, the throughput of the metrology module will be improved. Enhancing the throughput of a metrology module will enable a higher sampling rate and improve the ability to detect problems with the process tool. Where the throughput of the metrology module is degrading the throughput of the process tool, the present invention will improve the ability to detect problems and enhance the throughput of the process tool. The present invention may be particularly advantageous when used in an integrated and/or in-situ metrology system. An embodiment of the present invention may also be used with a stand-alone metrology system to improve throughput of the metrology.

Figure 1:
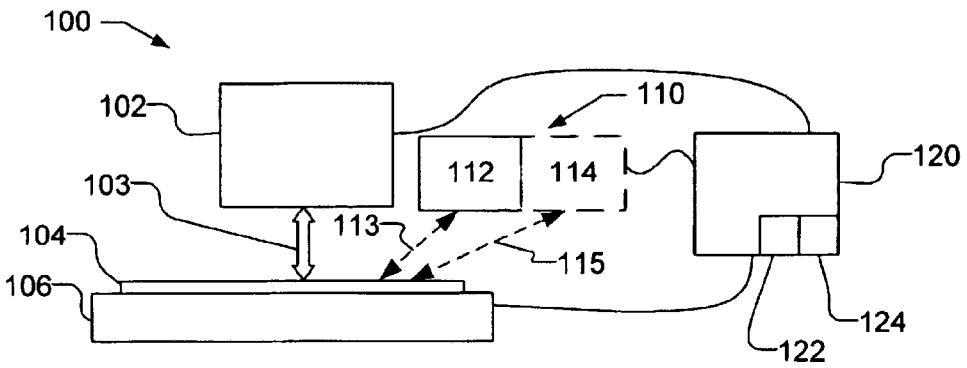
FIG. 1 shows a schematic view of processing and metrology apparatus, in accordance with an embodiment of the present invention.

FIG. 1 shows a schematic view of processing and metrology apparatus 100 in accordance with an embodiment of the present invention. Apparatus 100 includes a processing module 102, which may be, e.g., a chemical mechanical polishing (CMP) process, deposition, etching, or any other processing tool, which is desirable to monitor. Processing module 102 processes a substrate 104, as indicated by the double arrow 103. Substrate 104 is held on a chuck 106, which may be stationary or movable.

Apparatus 100 includes a metrology module 110, which may include one or more metrology tools 112 and 114, shown with broken lines to indicate that in some embodiments, metrology tool 114 is not present. The metrology tools 112 and 114 may be, e.g., a reflectometer, ellipsometer, differential interferometer, or any other appropriate metrology tool used to monitor the performance of processing module 102. The instruments in metrology module 110 may be coupled together or may be separate. The type of metrology tool used is dependent on the type of inspection desired, and is dependent on the processing module with which the metrology tool is being used. Some or all of the metrology tools of metrology module 110 may be in-situ with processing module 102 or integrated with processing module 102. Alternatively, some or all of the metrology tools of metrology module 110 may be a stand-alone. Moreover, it should be understood that the metrology tools in metrology module 110 need not be located in the same location, for example, metrology tool 112 may be in-situ, while metrology tool 114 may be integrated or a stand-alone tool.

Metrology module 110 measures one or more parameters of the substrate 104, as indicated by the broken arrows 113 and 115. Metrology module 110 may measure the parameters at more than one location. It should be understood that the substrate 104 may be examined by metrology module 110 while substrate is on chuck 106, e.g., when one or more tools in the metrology module 110 is in-situ, or alternatively substrate 104 may be moved, e.g., by way of a transport mechanism such as a robot arm, for inspection by metrology module 110, e.g., when one or more tools in metrology module 110 is an integrated tool. Further, in an embodiment where one or more tools in metrology module 110 is a stand-alone system, a plurality of processed substrates 104 may be transferred to metrology module 110 at one time for inspection. The transport of substrates between processing tools and metrology tools is well known in the art as is in-situ systems.

Apparatus 100 may also include a control system 120 that is electrically connected to the processing module 102, metrology module, chuck 106, and any transport mechanism. The control system 120 may be, e.g., a workstation, a personal computer, or central processing unit, e.g., Pentium 4™ or other adequate computer system. The control system 120 may include a memory unit 122, which may include random-access memory (RAM), and read-only memory (ROM) as well as a storage unit, e.g., a hard disk that stores a computer-usable medium having computer-readable program code embodied therein. The computer-readable program code may include instructions for performing the metrology technique in accordance with the present invention. Generating code to perform the present invention is well within the abilities of those skilled in the art in light of the present disclosure.

Figure 2:
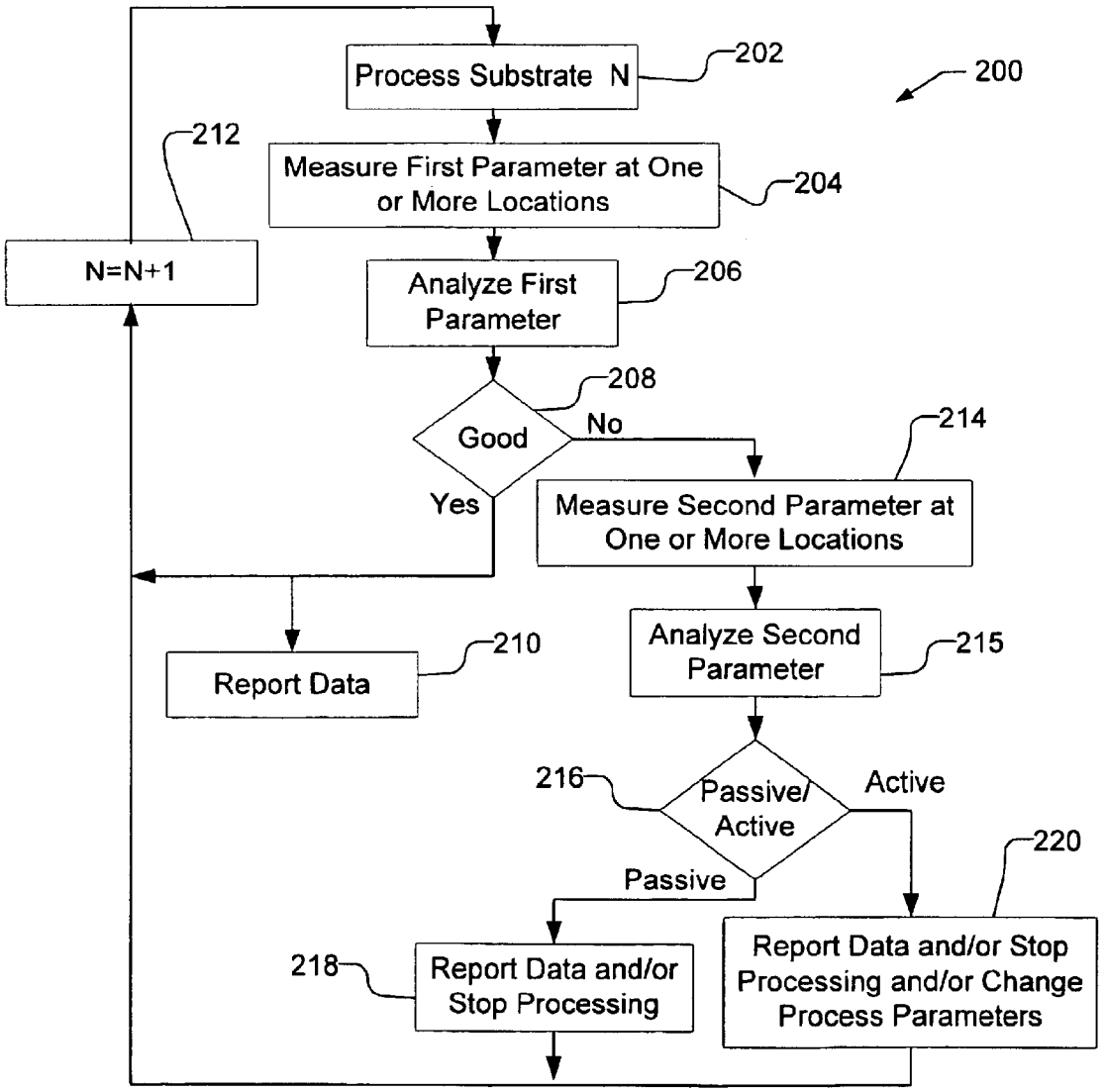
FIG. 2 shows a flow chart of the processing and metrology of a substrate in accordance with an embodiment of the present invention.

FIG. 2 is a flow chart 200 of the metrology process in accordance with an embodiment of the present invention. As shown in FIG. 2, a substrate is processed (block 202), e.g., using processing module 102 in FIG. 1. The metrology module 110 then measures a first parameter on the substrate (block 204). The first parameter may be measured at a plurality of locations on the substrate. The first parameter is then analyzed (block 206). If the first parameter is acceptable (block 208), the data is reported (block 210), and the next substrate is processed (blocks 212 and 202).

If, however, the first parameter is outside tolerance (block 208), the metrology module will then measure additional parameters on the substrate (block 214) and analyze the parameters (block 215). The additional parameters may be measured at a plurality of locations, which may be the same or different locations as measured for the first parameter. The choice of locations for the measurement of the additional parameters may be influenced by the results of the measurement of the first parameter.

If the metrology module is in passive mode, the data for the first and second parameters is reported, e.g., to the engineer, or the process can be terminated until the problem is addressed based on the metrology results (block 216). Active mode is similar to passive mode, except that the process may be automatically modified if the deviation from the tolerance range is not excessive to attempt to address the problems indicated by the metrology results (block 218). Once the appropriate action has been taken, the process continues with the next substrate (blocks 212 and 202).

Typically, if the process if found to have varied an excessive amount, the engineer must decide how to save some fraction of the die from the one or more wafers independent of the process tool/metrology system by continuing to the next process steps or reprocessing the wafer in the current process tool. A decision must also be made to continue processing subsequent wafers or stop processing to address the problems associated with the process tool or problems caused by previous process steps.

Thus, by analysis of the data from the first parameter, it can be determined whether additional measurements of other parameters are necessary. Measurements of additional parameters are only made when analysis of this data from the first parameter indicates that it is necessary. Additionally, the measurement of additional parameters can be done only in locations on the wafer that are deemed necessary. Accordingly, time is not spent on measuring unnecessary parameters at unnecessary locations, as is conventionally done.

In one exemplary embodiment, the processing module 102 in FIG. 1 may be a conventional copper CMP processing tool, such as the Mirra or Mirra Mesa systems manufactured by Applied Materials located in Santa Clara, Calif. Chemical mechanical polishing is a well-known process used to remove and planarize layers of material deposited on a semiconductor device. As is well known, to remove and planarize the layers of the deposited material, which may include dielectric and metal materials, CMP typically involves wetting a pad with a chemical slurry containing abrasive components and mechanically polishing the surface of the semiconductor device against the wetted pad to remove the layers of deposited materials.

With CMP, the substrate may be under processed leaving a residue of the material that should have been removed. The residue may create shorts between features rendering the device inoperative. Alternatively, the substrate may be over processed resulting in excessive dishing and erosion. Dishing and erosion are caused when the polishing reaches the top of a dielectric, the metal polishes faster than the dielectric resulting in the greater loss of the metal material relative to the dielectric material. This may cause excessive resistance degrading the performance of the device. After the CMP process, it is important to inspect the substrate to ensure that the substrate was processed within the acceptable tolerance range.

The metrology module 110 in FIG. 1 may include an interferometer plus a reflectometer, such as that produced by Nanometrics, Inc., located in Milpitas Calif., as model NanoCLP 9010, which may be used to monitor metal loss from the CMP process as well as residual metal on the sample.

After the substrate is processed by the CMP process tool 102, metrology module 110 measures the copper loss (the first parameter of block 204). If the metrology module 110 measures an abnormally small amount of copper loss, the substrate is under polished. Accordingly, there will be a high probability of residual metal on the dielectric regions surrounding the metal features. Thus, metrology module 110 will then measure the dielectric regions for residue (the second parameter of block 214). For example, if the middle of the metal loss tolerance range is 70 nm and the tolerance range extends from 50 to 90 nm, when the metal loss is measured at 45 nm at a location near the center of the wafer, it is likely that residuals are present in that region of the wafer.

However, if the metrology module 110 measures a normal or excessive amount of metal loss (the first parameter of block 204), the probability of residuals is suitably low and there is no need to monitor the dielectric regions for residual. This is true even though the measurement may indicate that the process exceeds the maximum specification limit for metal loss, e.g., more than 90 nm in the above example. The measurement of the dielectric regions for residue can then be bypassed.

Thus, while a constant measuring frequency for the first parameter, metal loss in this example, the measuring frequency of the second parameter, residue in this example, is variable and is dependant upon the results of the first parameter. Accordingly, in this embodiment of the present invention, throughput of the metrology module is improved by only measuring for the second parameter when and where there is a high probability of the second parameter being out of tolerance. The present invention also maximizes the sensitivity of the metrology module to process anomalies while maintaining a high throughput.

It should be understood that the present invention is not limited to measuring metal loss and residue, but any parameters of interest. For example, it may be desirable to measure erosion, as opposed to metal loss. Thus, for example, based on the amount of measured erosion, it may be desirable to measure the other parameter of residue.

It should further be understood that the present invention is not limited to the use with CMP processing, but may be used in conjunction with any processing tool in order to enhance throughput of the measurement of multiple parameters. For example, the present invention may be used advantageously with lithography and/or etching, which use various metrology tools to monitor critical dimension. When monitoring the lithography/etch process, the transparent film properties, such as refractive index, can be measured using an ellipsometer to predict possible changes in the critical dimension. If the refractive index changes from an expected value, then the critical dimension is measured directly using a scanning electron microscope (CD-SEM) or similar instrument. If, however, the refractive index does not change beyond an expected value, the critical dimension is not directly measured in order to increase throughput.

In another embodiment, the first parameter and the second parameter may be same, e.g., critical dimension (CD). In one embodiment, the first metrology tool 112 may be an optical critical dimension metrology tool, such as the NanoOCD 9000 manufactured by Nanometrics, Inc. and the other metrology tool 114 may be a CD-SEM, such as the NanoSEM 3D System manufactured by Applied Materials. In this embodiment, measurements of the CD parameter are made using the first metrology tool 112. If the results are within acceptable tolerance, no further measurements are necessary. If, however, the results are out of the range of acceptable tolerance for one or more measurement locations, the same CD parameter may be measured using a CD-SEM at those measurement locations. Accordingly, the number of locations where the more time consuming CD-SEM metrology process is used will be reduced through the use of the OCD metrology process.

Although the present invention is illustrated in connection with specific embodiments for instructional purposes, the present invention is not limited thereto. Various adaptations and modifications may be made without departing from the scope of the invention. For example, the decision to measure additional parameters may be based on one or more previously parameters. Moreover, analysis of the first parameter (block 206 in FIG. 2) may be used to determine if more than one additional parameter should be measured or what type of additional parameters, if any, should be measured. Further, it should be understood that the present invention may be used with any substrate that undergoes processing, e.g., flat panel display or substrates used in the manufacture of sliders, and is not limited to use with semiconductor wafers. Therefore, the spirit and scope of the appended claims should not be limited to the foregoing description.

What is claimed is:

1. A method comprising:

measuring a first parameter of a substrate after the substrate has been processed;

analyzing the data from the measured first parameter; determining whether to measure a second parameter of said substrate based on the analyzed data; and measuring the second parameter when determined based on the analyzed data.

2. The method of claim 1, further comprising:

analyzing the data from the measured second parameter.

3. The method of claim 2, further comprising reporting the data from the measured first parameter and the second measured parameter.

4. The method of claim 2, further comprising stopping the processing of substrates.

5. The method of claim 2, further comprising using at least one of the data from the measured first parameter and the second measured parameter to adjust the processing of a subsequent substrate.

6. The method of claim 1, further comprising:

processing a second substrate;

measuring said first parameter of said second substrate;

analyzing the data from the measured first parameter of said second substrate; and determining whether to measure a second parameter of said second substrate based on the analyzed data from the measured first parameter of said second substrate.

7. The method of claim 1, wherein the substrate has been processed by chemical mechanical polishing and wherein said first parameter is metal loss on said substrate and said second parameter is residue on said substrate.

8. The method of claim 1, wherein said first parameter is measured from a plurality of locations on said substrate.

9. The method of claim 2, wherein said second parameter is measured from a plurality of locations on said substrate.

10. The method of claim 1, further comprising:

determining where to measure a second parameter of said substrate based on the analyzed data;

measuring a second parameter of said substrate at specific locations on said substrate; and analyzing the data from the measured second parameter.

11. The method of claim 2, where said first parameter and said second parameter are the same parameter that is measured using different metrology tools.

12. The method of claim 11, wherein said first and second parameter is a critical dimension, wherein measuring said first parameter is performed using an optical critical dimension tool and wherein measuring said second parameter is performed using a critical dimension scanning electron microscope tool.

13. The method of claim 1, wherein the substrate has been processed by chemical mechanical polishing and wherein said first parameter is erosion on said substrate and said second parameter is residue on said substrate.

14. An apparatus comprising:

a processing module that processes a substrate;

a metrology module, the metrology module measures a first parameter and a second parameter of a substrate processed by said processing module;

a computer system coupled to said processing module and said metrology module, said computer system receiving a first set of data of said first parameter from said metrology module and a second set of data of said second parameter from said metrology module, said computer system having a computer-usable medium having computer-readable program code embodied therein for:

instructing said metrology module to measure said first parameter of a substrate after the substrate has been processed;

analyzing the data from the measured first parameter; and determining whether to measure a second parameter of said substrate based on the analyzed data.

15. The apparatus of claim 14, wherein said computer-readable program code is further for:

instructing said metrology module to measure said second parameter of a substrate; and analyzing the data from the measured second parameter.

16. The apparatus of claim 14, wherein said computer-readable program code is further for reporting the data from the measured first parameter and the second measured parameter.

17. The apparatus of claim 14, wherein said computer-readable program code is further for stopping said processing module from processing subsequent substrates.

18. The apparatus of claim 14, wherein said computer-readable program code is further for adjusting said processing module using at least one of the data from the measured first parameter and the second measured parameter.

19. The apparatus of claim 14, wherein said processing module is a chemical mechanical polisher, and wherein said first parameter is metal loss on said substrate and said second parameter is residue on said substrate.

20. The apparatus of claim 14, wherein said processing module is a chemical mechanical polisher, and wherein said first parameter is erosion on said substrate and said second parameter is residue on said substrate.

21. The apparatus of claim 14, where said first parameter and said second parameter are the same parameter that is measured using different metrology tools.

22. The apparatus of claim 21, wherein said first and second parameter is a critical dimension, wherein said metrology module includes an optical critical dimension tool and a critical dimension scanning electron microscope tool.

23. An apparatus comprising:

a processing module that processes a substrate;

a metrology module, the metrology module measuring a critical dimension at least at one location on said substrate, said metrology module including a first critical dimension measuring tool and a second critical dimension measuring tool;

a computer system coupled to said processing module and said metrology module, said computer system receiving a first set of data of said critical dimension from said first critical dimension measuring tool and a second set of data of said critical dimension from said second critical dimension measuring tool, said computer system having a computer-usable medium having computer-readable program code embodied therein for:

instructing said metrology module to measure said critical dimension with said first critical dimension measuring tool after the substrate has been processed;

analyzing the data from the first critical dimension measuring tool; and determining whether to measure the critical dimension with the second critical dimension measuring tool based on the analyzed data.

24. The apparatus of claim 23, wherein said computer-readable program code is further for:

instructing said second critical dimension measuring tool to measure said critical dimension; and analyzing the data from the second critical dimension measuring tool.

25. The apparatus of claim 23, wherein said first critical dimension measuring tool is an optical critical dimension tool and said second critical dimension measuring tool is a critical dimension scanning electron microscope tool.

26. The method of claim 1, wherein the substrate has been processed by chemical mechanical polishing and wherein said first parameter is dishing on said substrate and said second parameter is residue on said substrate.

27. The apparatus of claim 14, wherein said processing module is a chemical mechanical polisher, and wherein said first parameter is dishing on said substrate and said second parameter is residue on said substrate.

28. A method comprising:

processing a substrate;

measuring a first parameter of the substrate after the substrate has been processed;

analyzing the data from the measured first parameter;

determining whether data from the measured first parameter is within tolerance for the first parameter;

measuring a second parameter of said substrate when the data from the measured first parameter is determined to be out of the tolerance for the first parameter.

29. The method of claim 28, wherein the substrate has been processed by chemical mechanical polishing and wherein said first parameter is metal loss on said substrate and said second parameter is residue on said substrate.

30. The method of claim 29, wherein determining whether data from the measured first parameter is within tolerance for the first parameter comprises determining whether the measured metal loss on said substrate is below a minimum metal loss tolerance.

31. The method of claim 28, wherein the substrate has been processed by chemical mechanical polishing and wherein said first parameter is erosion on said substrate and said second parameter is residue on said substrate.

32. The method of claim 28, wherein the first parameter and the second parameter are critical dimension, wherein measuring the first parameter is performed using an optical critical dimension tool and wherein measuring the second parameter is performed using a critical dimension scanning electron microscope tool.

* * * * *